US005692582A

United States Patent [19]

Lindemood

[11] Patent Number: 5,692,582

[45] Date of Patent: Dec. 2, 1997

[54] UPRIGHT COLUMN CLIMBING DEVICE

[76] Inventor: Norman R. Lindemood, 6435 Cir. Vale S.E., East Canton, Ohio 44730

[21] Appl. No.: 583,181

[22] Filed: Jan. 4, 1996

[51] Int. Cl.[6] ..... A63B 27/00

[52] U.S. Cl. ..... 182/133; 182/187

[58] Field of Search ..... 182/133, 135, 182/136, 142, 187

[56] References Cited

U.S. PATENT DOCUMENTS

| | | | |
|---|---|---|---|
| 2,414,538 | 1/1947 | Lamb | 304/13 |
| 3,568,797 | 3/1971 | Hardy | 182/142 |
| 3,731,762 | 5/1973 | Sirls | 182/142 |
| 3,935,874 | 2/1976 | Cohen | 135/16 |
| 3,968,858 | 7/1976 | Vollan et al. | 182/135 |
| 4,137,995 | 2/1979 | Fonte | 182/135 |
| 4,205,733 | 6/1980 | Wade | 182/142 |
| 4,347,913 | 9/1982 | Cromer, Jr. | 182/142 |
| 4,886,143 | 12/1989 | Dubroc | 182/142 |
| 4,921,069 | 5/1990 | Boyles | 182/135 |
| 4,987,972 | 1/1991 | Helms | 182/187 |
| 5,090,505 | 2/1992 | Amacker | 182/187 |
| 5,117,942 | 6/1992 | Tzavaras | 182/142 |
| 5,180,030 | 1/1993 | Smaby | 182/187 |
| 5,507,362 | 4/1996 | Krueger | 182/187 X |

FOREIGN PATENT DOCUMENTS

| | | | |
|---|---|---|---|
| 2627175 | 8/1989 | France | 182/187 |

*Primary Examiner*—Alvin C. Chin-Shue
*Attorney, Agent, or Firm*—Sand & Sebolt

[57] ABSTRACT

A vertical columnar member climbing device having an upper climbing assembly and a lower climbing assembly connected by a pair of elastic connectors. The climbing device provides a frame and a step pivotally attached to the frame. A cable extends outwardly from the frame and extends around the vertical columnar member and is spring biased to tighten around the columnar member thereby securing the upper climbing assembly to the columnar member. The upper assembly may be pivoted outwardly away from the tree with the step being pivoted downwardly to operate as a diagonal brace intermediate the upper climbing assembly and the vertical columnar member with a separate strap extending outwardly from the frame around the columnar to further secure the upper climbing assembly to the tree. A sling is suspended from the upper climbing assembly above the lower climbing assembly to support a user. An umbrella may be rotated outwardly from the upper climbing assembly and a plurality of camouflaged shields may be suspended therefrom for shielding the user from the environment.

24 Claims, 15 Drawing Sheets

UPRIGHT COLUMN CLIMBING DEVICE

BACKGROUND OF THE INVENTION

1. Technical Field

The present invention is directed generally to an upright column climbing device. More particularly, the present invention relates to a tree climbing device and stand. Specifically, the present invention relates to a tree climbing device which permits the user to safely climb a tree, and which converts to a suitable tree stand of the type which suspends a user above the ground.

2. Background Information

Hunters have long positioned themselves in a position elevated above the ground, such as in a tree. Hunting from a tree is safer for the hunter and also offers the hunter an improved view of the animal from a greater distance. Additionally, hunting from a tree offers the hunter improved stealth since an elevated hunter is less likely to be noticed by the animal either visually, or from the hunter's scent. While hunting from a position elevated above the ground offers the hunter the above advantages; sitting, standing or otherwise positioning oneself in a tree, often for extended periods of time, is often awkward and uncomfortable. Additionally, the mobility of a hunter positioned in a tree is severely limited by the branches, limbs and leaves adjacent his position and by the immobility of the seating available in the tree. This immobility severely restricts the hunter's ability to face varying directions thereby limiting the hunter's effectiveness.

In order to overcome the above referenced problems, a variety of upright column climbing and support devices have been developed. Such upright column climbing and support devices, commonly known as tree stands, have been used for many years to aid hunters in gaining an advantage over large and often hostile animals. Tree stands have also been used by lookouts and marksmen in times of war to gain advantage over an opposing foe. In more recent years, tree stands have been used by sportsmen to hunt game, and by naturalists and photographers to view and photograph wildlife. In more recent years, pole seats or stands have been used in other areas having upright and columnar members such as by utility workers who must climb wood poles and repair electrical or telephone lines supported by the poles.

While a number of existing tree stands have been developed which are presumably adequate for the purpose for which they are intended, one difficulty encountered in the use thereof is the difficulty in climbing the tree and locking the stand to the tree at a proper elevated position. Stationary or non-climbing tree stands must be positioned in the final location within the tree by either climbing the tree by hand, utilizing a ladder or other means of climbing the tree, or utilizing tree spikes to climb the tree. Regardless of the method utilized to scale the tree, the stand must be carried by hand while scaling the tree. Additionally, once the stand is appropriately positioned within the tree, external means must be utilized for ingress and egress to and from the stand respectively. Another problem associated with stationary tree stands, is that often users will be injured when falling from the stand. Specifically, it is not uncommon for a hunter, when positioned for long hours on a tree stand, to fall asleep and fall from the stand. Alternatively, when the stand is used in inclimate weather, snow and ice may build up on the stand, causing slippery conditions, and consequently a user may fall from the stand.

Conversely, several tree climbing stands are known in the art. These climbing tree stands allow the user to incrementally ratchet up the tree. These tree stands often includes two climbing assemblies. The user moves the upper climbing assembly up the tree an incremental amount while supporting himself on the lower climbing assembly. The user then shifts his weight to the upper climbing assembly and moves the lower climbing assembly incrementally upward. This iterative process is continued until the tree stand is properly positioned. While these devices are presumably adequate for the purpose for which they are intended, a severe safety hazard is created thereby. Specifically, if the user does not securely lock the assembly which will support his weight to the tree, the second assembly will slide down the entire length of the tree and severely injure the user. Additionally, existing climbing tree stands are not stable during the weight shifting operation.

Regardless of whether a stationary or climbing tree stand is utilized, the units are generally bulky in size and weight, and complex in operation.

The need thus exists for a lightweight tree climbing stand which will permit the user to climb the tree, and which converts to a tree stand which safely secures the user to the tree to prevent the user from inadvertently falling off of the stand. The need also exists for a tree stand which will prevent the user and the tree climbing device from inadvertently sliding down the tree should the user's weight be incorrectly positioned on the tree climbing device.

SUMMARY OF THE INVENTION

Objectives of the invention include providing an improved tree climbing device that is convertible from a tree climbing device to a tree stand for supporting the user in an elevated position above the ground.

Another objective of the invention includes providing a tree climbing device which prevents the user and the device from falling during the climbing operation.

A still further objective of the invention is to provide a tree climbing device wherein the upper climbing portion and the lower climbing portion are connected via elastic straps whereby the lower climbing portion may only fall relative to the upper climbing portion a distance equal to the length of the strap.

Yet another objective of the invention is to provide a tree climbing device in which the straps assist in raising the lower portion relative to the upper portion during the climbing operation.

Still a further objective of the invention is to provide a tree climbing device which, when converted into a tree stand, prevents the user from inadvertently falling from the stand.

Another objective of the invention is to provide a tree climbing device which, when converted into a tree stand, suspends the user outwardly away from the tree.

Yet another objective of the invention is to provide a tree climbing device, which when converted to a stand, supports the hunter in a suspended sling.

A still further objective of the invention is to provide a tree climbing device which is compact and lightweight.

A still further objective of the invention is to provide a tree stand which includes protection from the elements and camouflage from animals being hunted, photographed or viewed.

A still further objective is to provide a tree climbing device which is of simple construction, which achieves the stated objectives in a simple, effective and inexpensive manner, and which solves problems and satisfies needs existing in the art.

These and other objectives and advantages of the improved invention are obtained by the tree climbing device for securing a hunter in a position elevated above the ground, the general nature of which may be stated as including an upper climbing assembly adapted to engage a generally vertical columnar member; a lower climbing assembly adapted to engage the generally vertical columnar member; at least one elastic member connecting the upper and lower climbing assemblies; and a user support for suspending the user from the upper climbing assembly, above the lower climbing assembly.

BRIEF DESCRIPTION OF THE DRAWINGS

The preferred embodiment of the invention illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
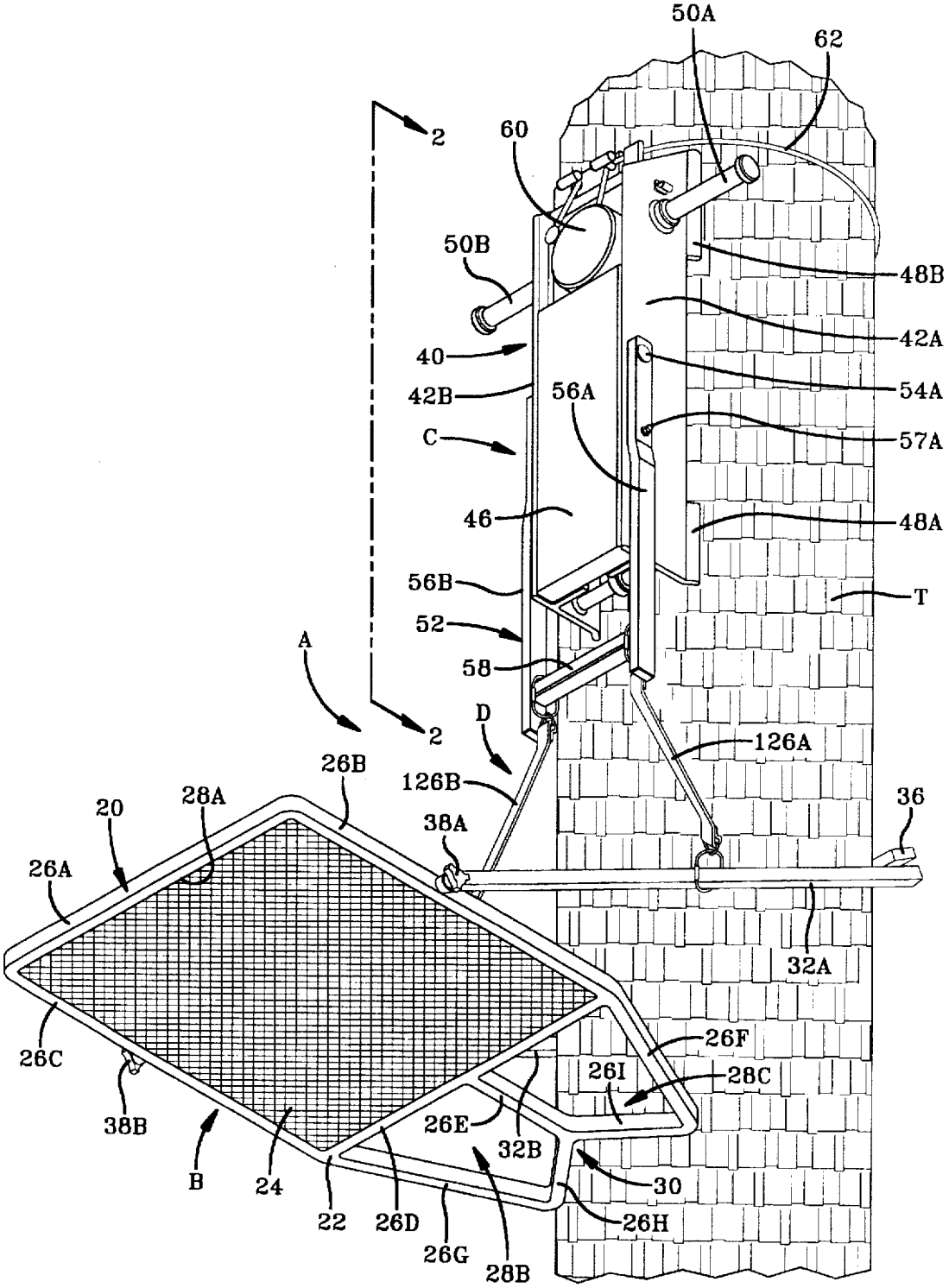
FIG. 1 is a perspective view of the preferred embodiment of a tree stand affixed to a tree in the climbing position.
Figure 2:
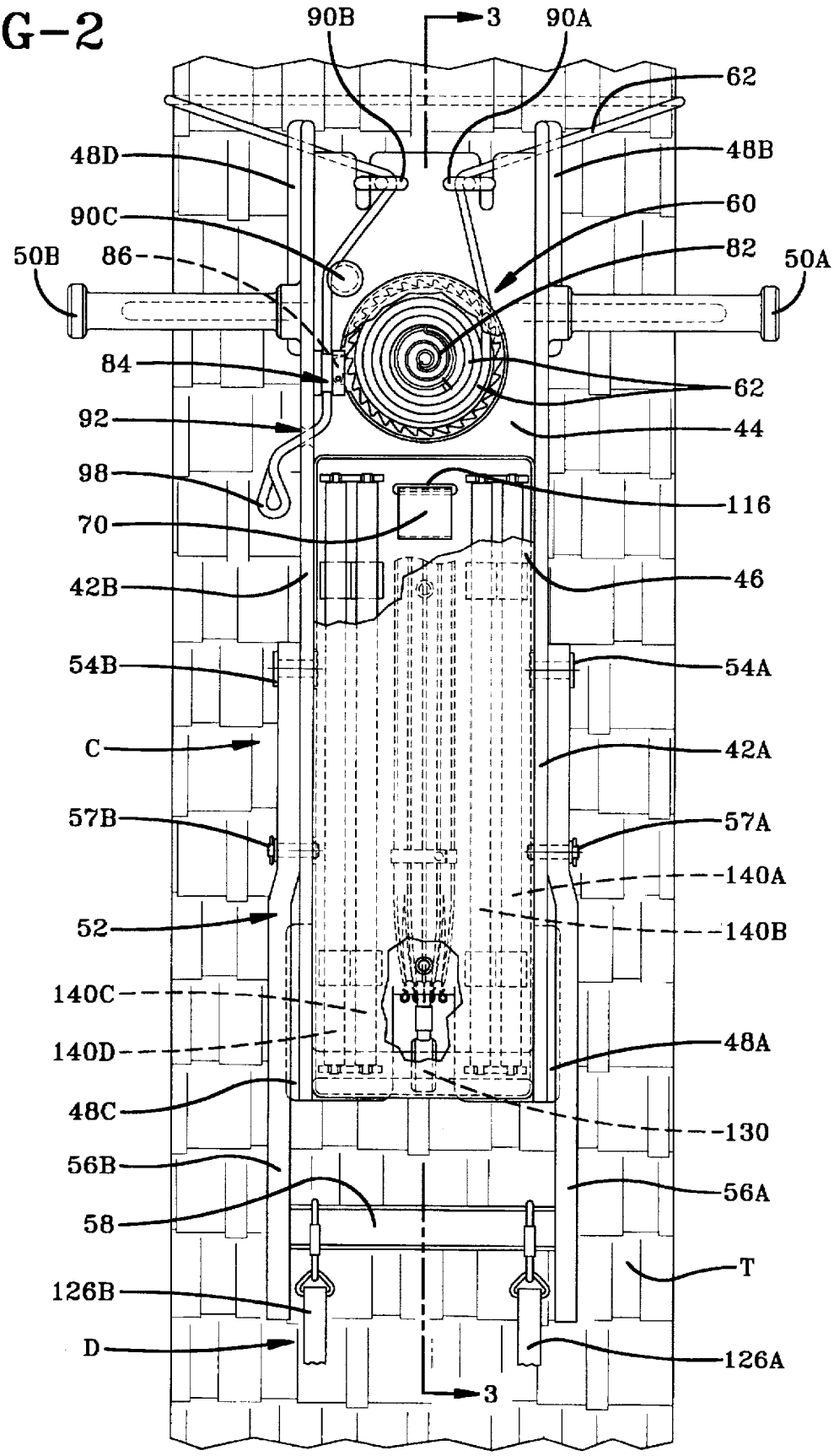
FIG. 2 is a front elevational view of the tree stand of FIG. 1 looking in the direction of line 2—2, FIG. 1 partially broken away to expose several internal parts.
Figure 3:
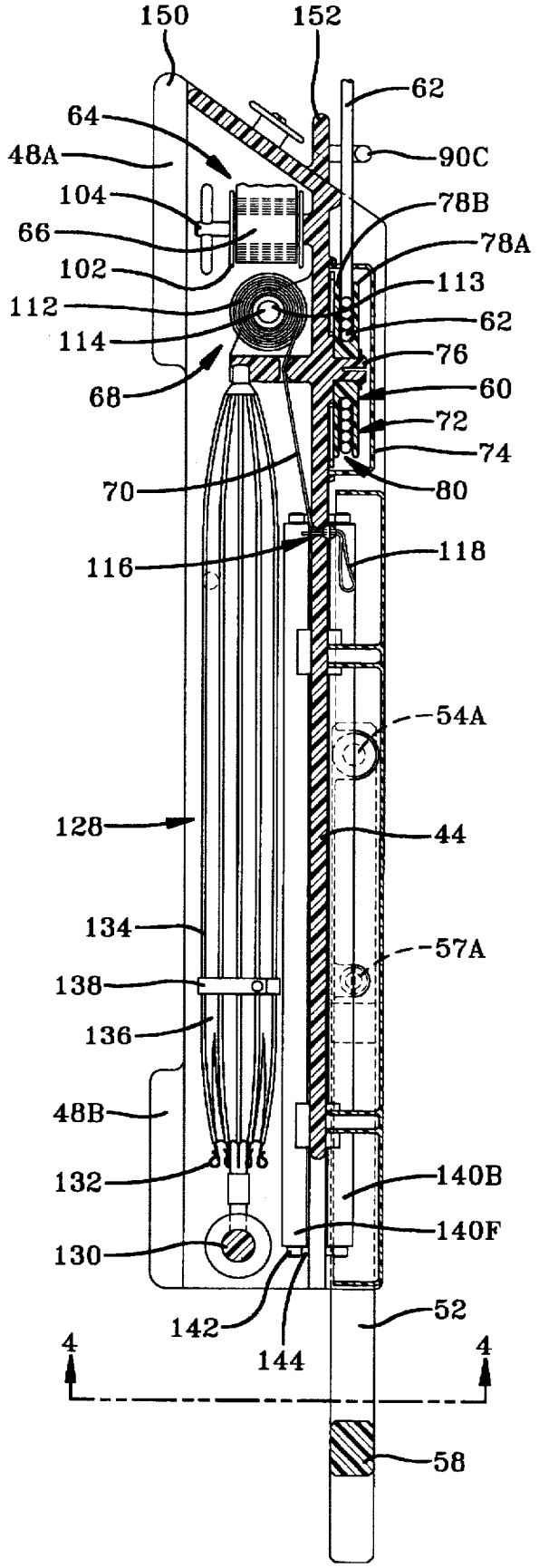
FIG. 3 is a sectional view of the tree climbing device of FIGS. 1 and 2 taken along line 3—3 FIG. 2.
Figure 4:
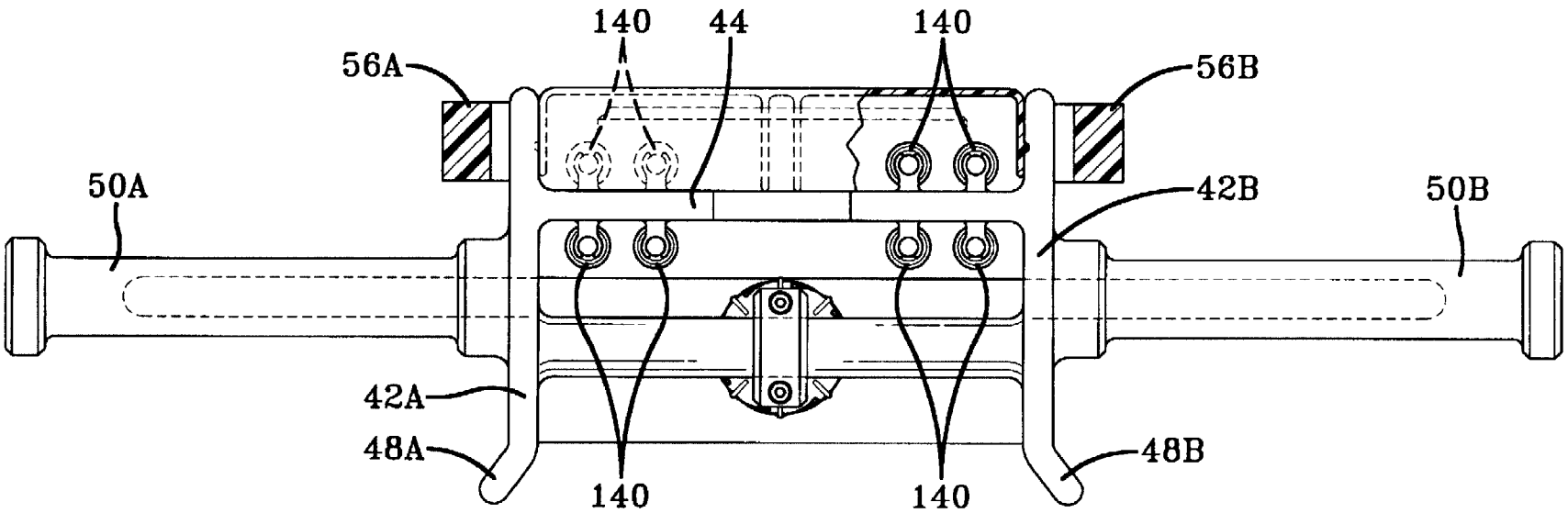
FIG. 4 is a sectional view of the tree climbing device of FIGS. 1–3 taken along line 4—4 in FIG. 3.

The improved climbing device or climbing tree stand of the invention is indicated generally at A, and is illustrated generally in FIGS. 1–3. Climbing tree stand A includes two main climbing assemblies: a lower climbing assembly B and an upper climbing assembly C that are connected by a flexing assembly D. Climbing tree stand A is shown in FIG. 1 affixed to a tree T at or near the base of the tree or partially up the tree prior to final positioning and anchoring.

Figure 5:
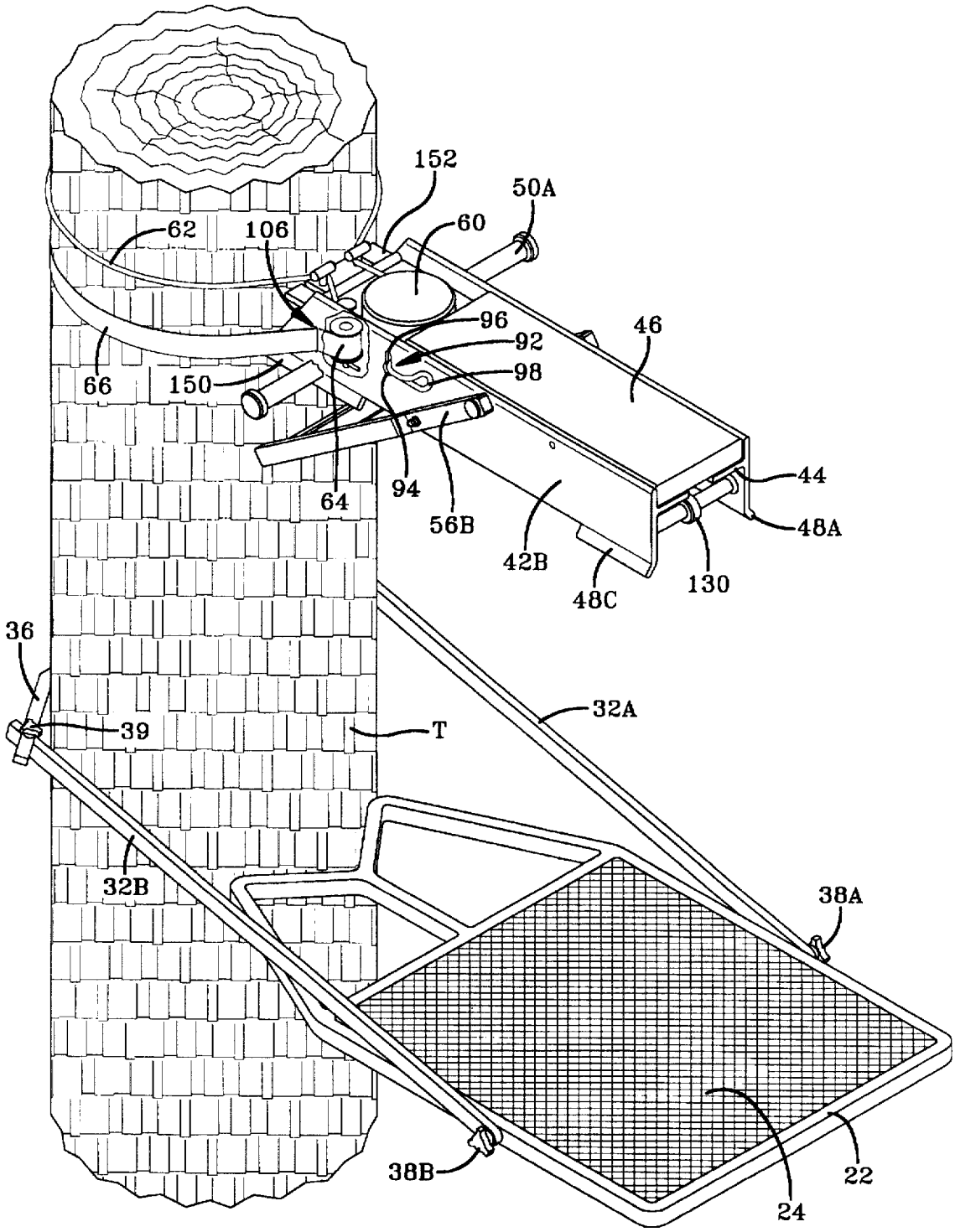
FIG. 5 is a perspective view of the preferred embodiment of FIG. 1 with the tree climbing device converted to a tree stand position.

Lower climbing assembly B includes a platform 20 having a platform frame 22 with a grate 24 positioned thereon. Frame 22 specifically includes a plurality of support members 26A, 26B, 26C, 26D, 26E, 26F, 26G, 26H, and 26I defining a square grate receiving portion 28A, and two open portions 28B and 28C. The angled positioning of support members 26H and 26I on the two open portions define a tree engaging groove or wedge 30. A pair of arms 32A and 32B are pivotally connected to support members 26B and 26C, respectively, by lugs 38A and 38B. A cross connect arm 36 connects the opposite end of the two arms together using finger screws 39 (FIG. 5) to allow lower climbing assembly A to engage tree T. Cross connect arm 36 is wedge-shaped to engage tree T on the opposite side of tree T engaged by wedge 30.

Referring to FIGS. 1–4, upper climbing assembly C includes a rigid frame 40 having a pair of parallel and spaced apart sides 42A and 42B, a stretcher beam 44, and a pivotable cover 46. Each side 42A and 42B is formed with a pair of bent flanges 48A and 48B, and 48C and 48D, respectively. Flanges 48 engage tree T. Frame 40 also includes an edge 150 and a stop 152 for engaging tree T in a manner described below.

In accordance with one of the features of the present invention, upper climbing assembly C includes a pair of handles 50A and 50B, and a step 52. Handle 50A extends transversely from sides 42A, while handle 50B extends transversely from side 42B. Step 52 is pivotally connected to sides 42A and 42B by lugs 54A and 54B, respectively and includes two parallel and spaced apart bars 56A and 56B connected together by a connector bar 58 extending transversely between bars 56. One of a pair of snap locking pins 57A and 57B engage an aperture 59 formed in each bar 56 whereby the interaction of snap locks 57 and apertures 59 prevent the pivotal movement of step 52 relative to sides 42. Frame 40 further includes a cable retraction mechanism 60 having a cable 62 wound therearound, a safety belt retraction mechanism 64 having a safety belt 66 wound therearound, and a support belt retraction mechanism 68 having a seat support belt 70 wound therearound.

Cable retraction mechanism 60 includes a pulley-shaped cable tray 72 (FIGS. 2–3) rotatable in a cable enclosure 74. Tray 72 is mounted on a center pin 76 with two flat parallel and spaced apart, circular walls 78A and 78B extending circumferentially outwardly from pin 76. Walls 78A and 78B define a center channel 80 in which cable 62 is wound. Tray 72 also has a coil spring 82 (FIG. 2) for rotationally biasing tray 72 toward a position resulting in a rewound cable, and a toothed ratchet and pawl locking mechanism 84 for stopping the rewind biasing. Toothed ratchet and pawl locking mechanism 84 (FIGS. 2 and 10) has a pawl 86 spring loaded away from a plurality of teeth 88 carried by tray 72.

The portion of the cable unwrapped from cable tray 72 is guided by cable guides 90A, 90B, and 90C. Cable 62 extends out of the upper climbing assembly C through a keyhole 92 formed through side 42B. Keyhole 92 has a substantially circular portion 94 and a substantially elongated slot portion 96 that is of smaller width than the diameter of the substantially circular portion 94. The exposed end of cable 62 is tied or connected in a loop 98 by coupling 100.

Although cable 62 and coupling 100 are of a diameter smaller than slot portion 96, loop 98 has a larger diameter than the width of slot portion 96 but smaller than circular portion 94. The loop thus also acts to limit the retraction of cable 62 to the point at which the loop is adjacent slot portion 96 unless the loop is moved into the circular portion 94 through which it may pass.

Figure 10:
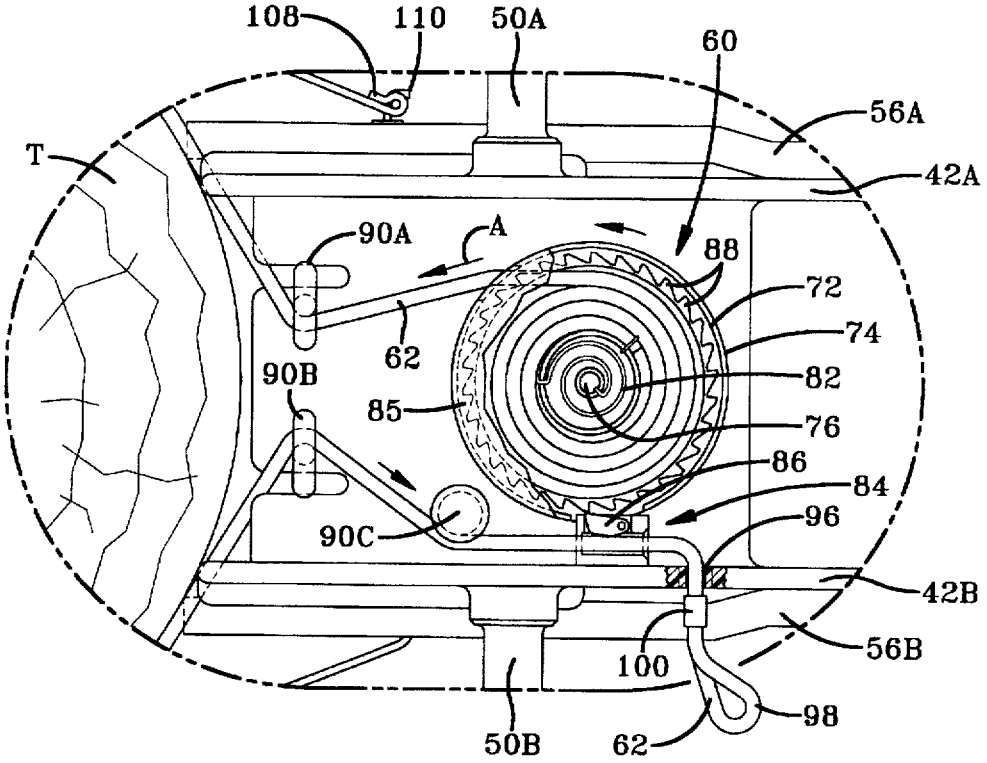
FIG. 10 is an enlarged view of the cable retraction mechanism with a portion of the cover cut away and with a portion of the cable unwound beyond the keyhole.
Figure 10A:
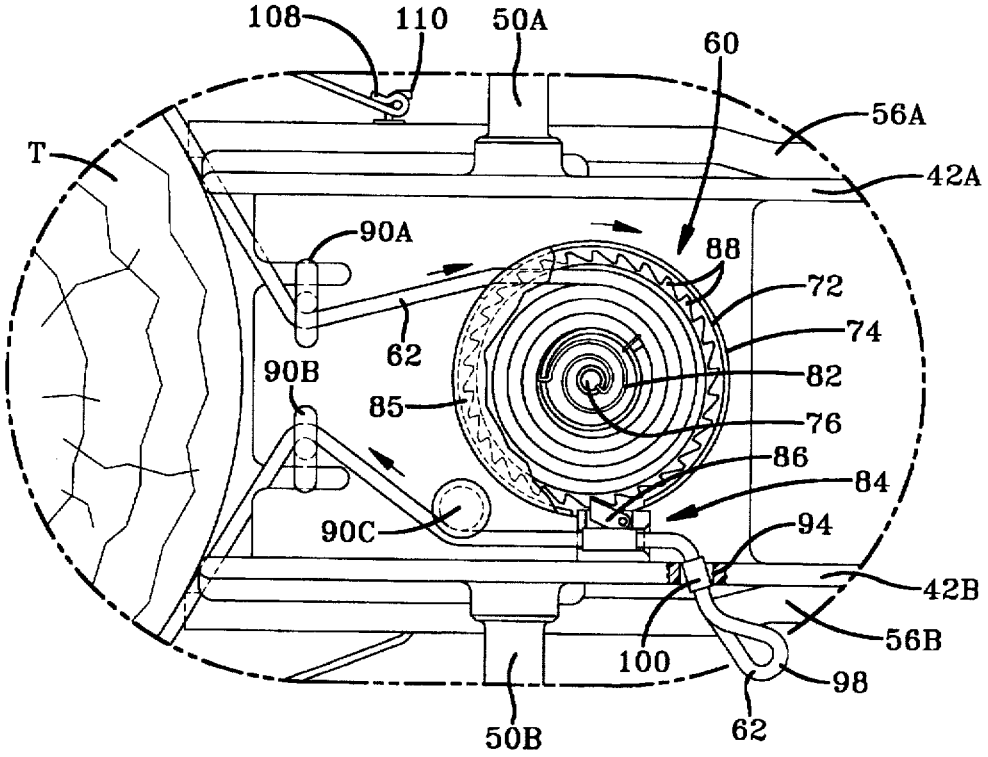
FIG. 10A is an enlarged view of the cable retraction mechanism as shown in FIG. 10 with the cable fully retracted to the keyhole.

Coupling 100, when pulled through keyhole 92 during cable retraction, actuates pawl 86. Specifically, coupling 100 has a larger diameter than cable 62 resulting in pawl 86 being pivoted inward into engagement with one of the plurality of teeth 88. The interaction between pawl 86 and teeth 88 thus prevents cable 62 from unwinding beyond the amount of cable 62 which was unreeled prior to the engagement of locking pawl 86 and teeth 88. However, further cable retraction is permitted as pawl 86 will cam over successive teeth 88 in response to force acting on cable 62 in the direction of arrow A (FIG. 10). Loop 98 prohibits further cable retraction once it is positioned adjacent keyhole 92.

Safety belt retraction mechanism 64 (FIG. 3) includes a safety belt 66 wrapped around a spool 102. Spool 102 rotates about a shaft 104 and is spring loaded so as to bias spool 102 toward rotation thereby automatically rewinding safety belt 66 around spool 102 absent a counteracting force or resistance. Safety belt 66 extends out of the upper climbing assembly C through a slit 106 formed in side 42B. A fastener 108 (FIG. 13) is attached to the exposed end of safety belt 66 and cooperates with a latch 110 on side 42A after the safety belt has been wrapped around tree T. Fastener 108 also acts to limit the retraction of safety belt 66 to the point at which fastener 108 is adjacent slit 106.

In accordance with another feature of the present invention, support belt retraction mechanism 68 includes support belt 70 wrapped around a spool 112. Spool 112 rotates about a shaft 114 and is spring loaded to bias spool 112 toward rotation thereby automatically rewinding support belt 70 around spool 112 absent a counteracting force or resistance. Support belt 70 extends out of the upper climbing assembly C through a slit 116 in stretcher beam 44 of rigid frame 40. A fastener 118 is attached to the exposed end of support belt 70 so as to fasten the support belt to a hooking mechanism 120 on a sling 122 in which a user U is seated. Fastener 118 also acts to limit the retraction of support belt 70 to the point at which fastener 118 is adjacent slit 116. The relative rotational position of spool 112 may be secured via a locking pawl 113.

Referring again to FIG. 1, a pair of elastic connectors 126A and 126B connect upper climbing assembly C to lower climbing assembly B. While elastic connectors 126 may take a variety of sizes and configurations, in the preferred embodiment, elastic connectors 126 are elastic rubber bands similar to bungy cords. The elastic connectors stretch between connector bar 58 on upper climbing assembly C and arms 32A and 32B of lower assembly B.

Figure 14:
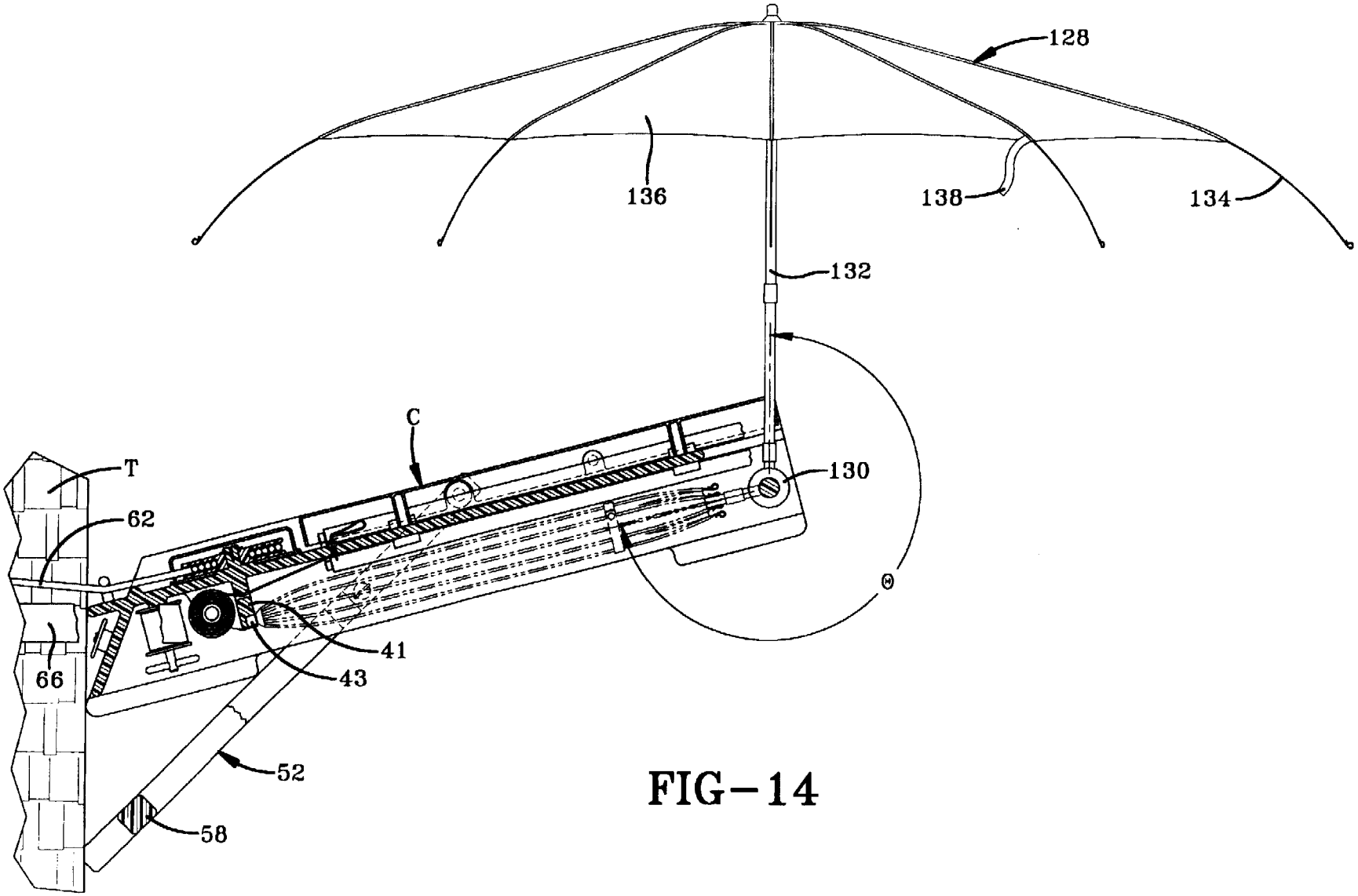
FIG. 14 is a sectional view of the upper climbing assembly with the umbrella removed and expanded.
Figure 15:
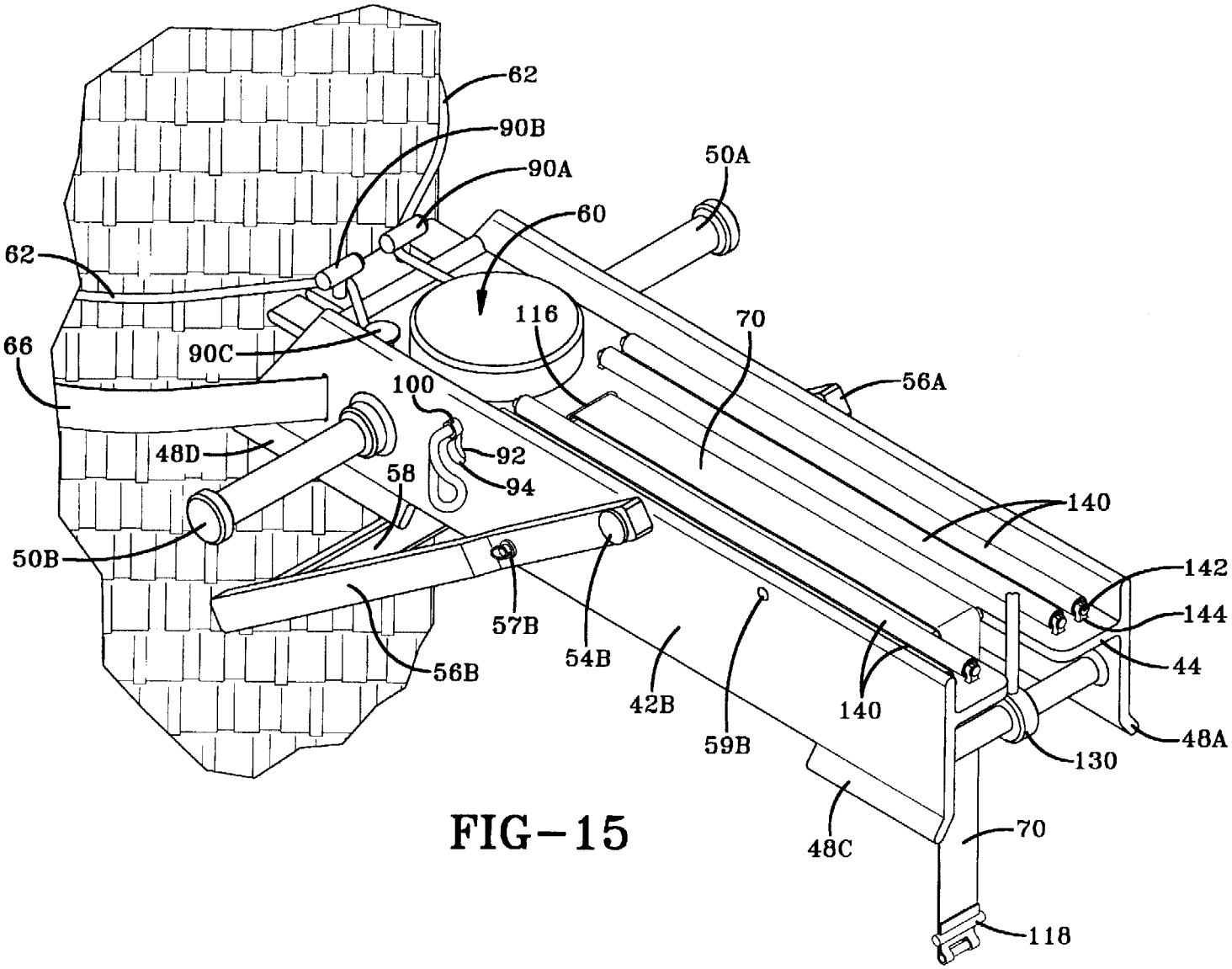
FIG. 15 is a perspective view similar to FIG. 6 with the support belt extended out of the upper climbing assembly.
Figure 16:
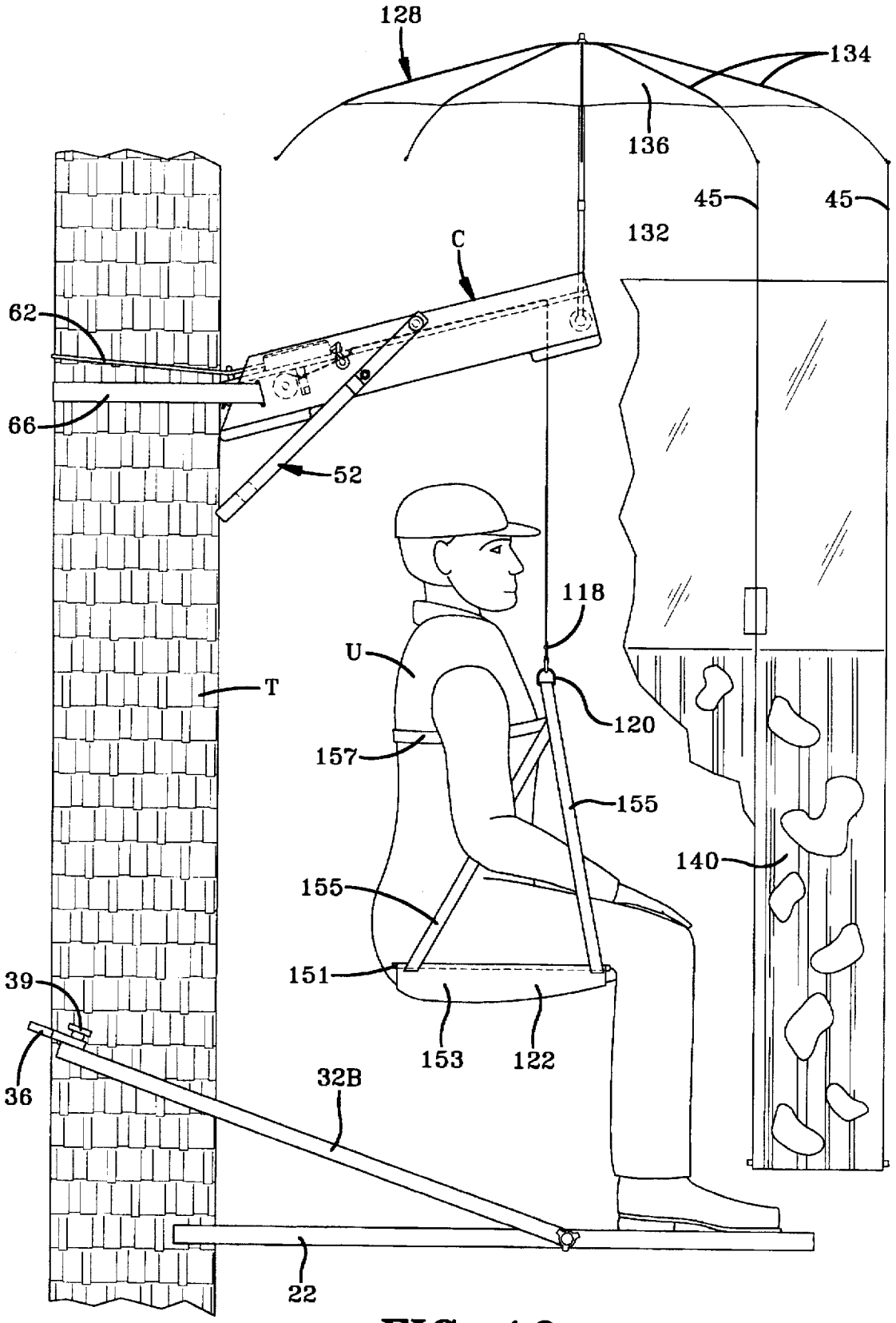
FIG. 16 is an elevational view of the tree climbing device in a tree stand position with the umbrella expanded, and with the camouflage shades unrolled, and the user positioned in the seat.

In accordance with another feature of the invention and referring to FIGS. 14–16, an umbrella 128 is pivotally connected to frame 40 at a pivot pin 130. Umbrella 128 is a collapsible umbrella with a center rod 132 and a plurality of outwardly extendible rods 134 connected at one end to center rod 132. A sheath 136 extends over and is attached to the plurality of outwardly extendible rods. A conventional tie strap 138 tightly binds the sheath covered rods 134 when collapsed and stored within frame 40. A flange 41 extends downwardly from frame 40 (FIG. 14) and includes a recess 43 complementary shaped to an end of center rod 132. The end of center rod 132 frictionally engages recess 43 of flange 41 to retain the same against rotational movement about pivot pin 130 when in the collapsed position.

Figure 7:
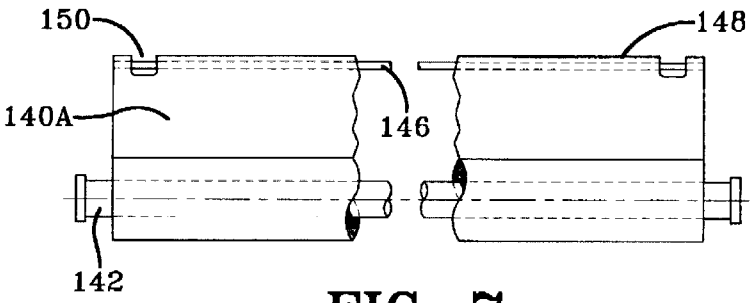
FIG. 7 is a plan view of one of the camouflage shades removed from the upper climbing assembly and partially unrolled.
Figure 6:
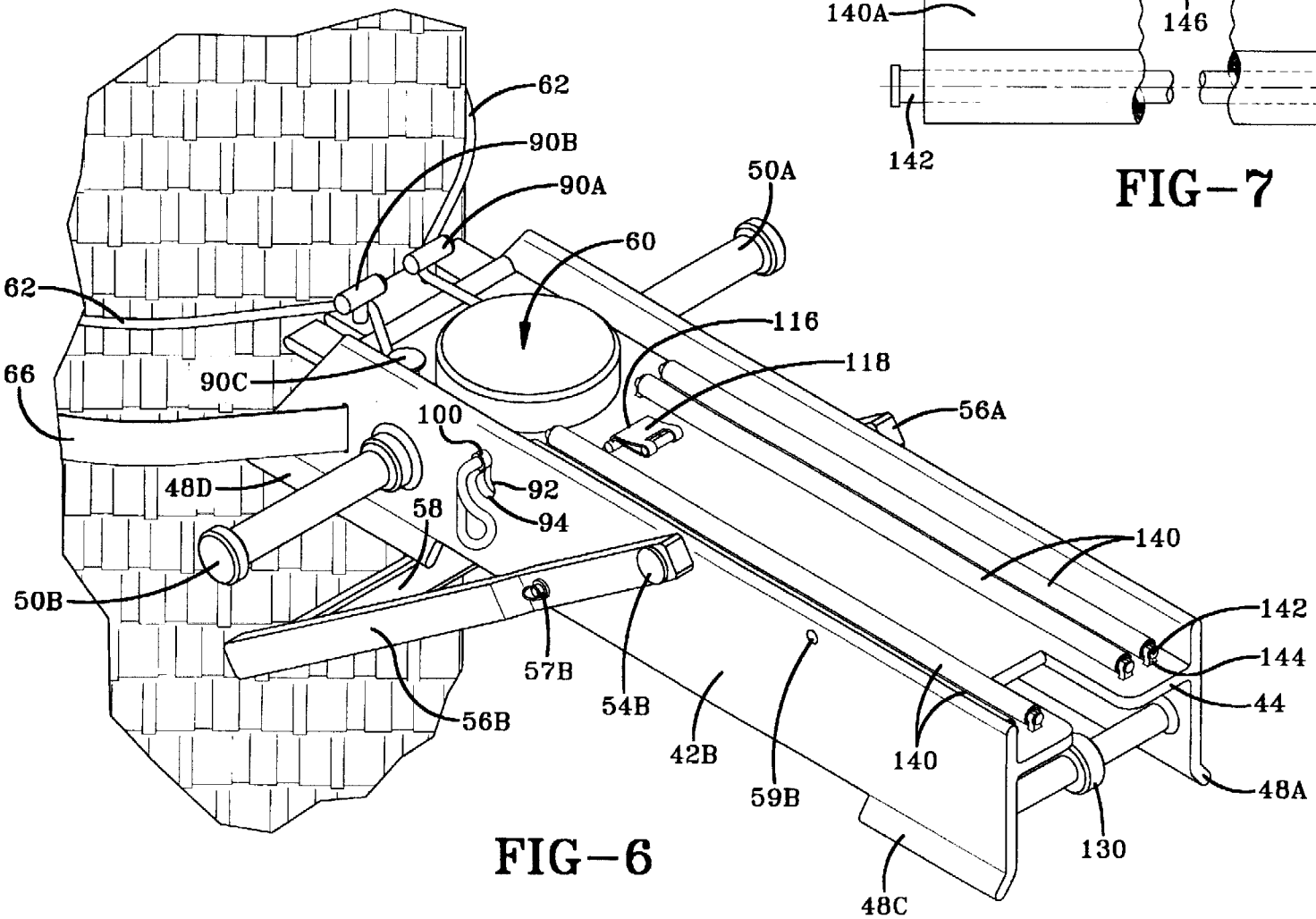
FIG. 6 is an enlarged perspective view of the upper climbing assembly with a cover removed.

Frame 40 also houses a plurality of rolled camouflage shades 140. Each shade 140 is rolled around a dowel rod 142 (FIGS. 3 and 7) with each dowel rod engaging a pair of storage clips 144 (as shown in FIG. 3) affixed to frame 40. Each storage clip 144 frictionally engages an end of a dowel rod 142 to retain the same against movement relative to frame 40. Each shade 140 includes a pair of strings 45 (FIG. 16) which may be attached to the ends of successive rods 134 to suspend each shade 140 when removed from the frame and unrolled so as to camouflage the user U from the animals which the user is hunting, viewing or photographing. Each shade 140 is a flat piece of material 144 with camouflage decor thereon. The end of the material opposite strings 45 receives dowel rod 142 to assure that each shade 140 remains substantially planar relative to strings 45. Additionally, it is noted that each shade is suspended some distance away from rods 134 to assure that the user may look over shades 140 when hunting, viewing or photographing animals.

Sling 122 is formed with a pair of parallel and spaced apart aluminum support bars 151 and an arcuately formed seat 153 extending thereover. A strap 155 extends upwardly from each corner of seat 153 and through hooking mechanism 120 to suspend the user above lower climbing assembly B. Additionally, an upper safety strap 157 extends around the back of the user just below the user's shoulder, and attaches to straps 155. The user is thus effectively retained within sling 122 and is prevented from falling out of sling 122 even if the user would inadvertently fall asleep as a result of the significant amount of time often spent suspended within sling 122.

In operation, loop 98 of cable 62 extends through an aperture in cable enclosure 74 which has a larger diameter than the cable diameter but smaller than the loop diameter so as to prohibit loop 98 from retracting into cable enclosure 74. Pawl 86 is released from engagement with teeth 88 so as to allow cable 62 to be unwound from tray 72. Loop 98 is pulled to overcome the resistance of coil spring 82 thereby unwinding a portion of cable 62 wound around tray 72. This unwound portion is wrapped around tree T so as to pull bent edges 48A–48D of upper climbing apparatus C against tree T. Cable 62 slides on cable guides 90A, 90B, and 90C which act to keep the cable properly aligned and to prevent the cable from binding due to unwanted interaction with frame 40.

Loop 98 is then inserted through the substantially circular portion 94 of keyhole 92 and slid into the substantially elongated slot portion 96 of keyhole 92. Pawl 86 reengages teeth 88 so as to prohibit any further unwinding of cable 62 from tray 72. Any slack in cable 62 is then released when the user U releases cable 62 so as to cause the cable retraction mechanism 60 to rewind the cable based upon the rewinding force provided by coil spring 82. Any further rewinding after loop 98 is tightly pulled against slot portion 96 is prohibited because of the smaller width of slot portion 96 in comparison to loop 98 which restricts cable 62 from any further retraction. Cable 62 is now loaded as is shown in FIGS. 1 and 2.

Arms 32A and 32B pivotally connected to support members 26B and 26C, extend along tree T so as to position tree engaging groove 30 against tree T. Cross-connect arm 36 connects the free end of the two arms together so as to secure lower climbing assembly B to tree T.

Preferably, frame 22 is positioned on tree T and angled relative thereto whereby tree engaging groove 30 is the lowest point of frame 22. Lower climbing assembly B thus acts as a cantilever when weight is placed on grate 24. Specifically, arms 32A and 32B are preferably connected to frame 22 about its midsection, and are preferably slanted upwardly relative to frame 22 as is shown in FIG. 1 thereby directing all weight placed on grate 24 against tree T at tree engaging groove 30.

Figure 8:
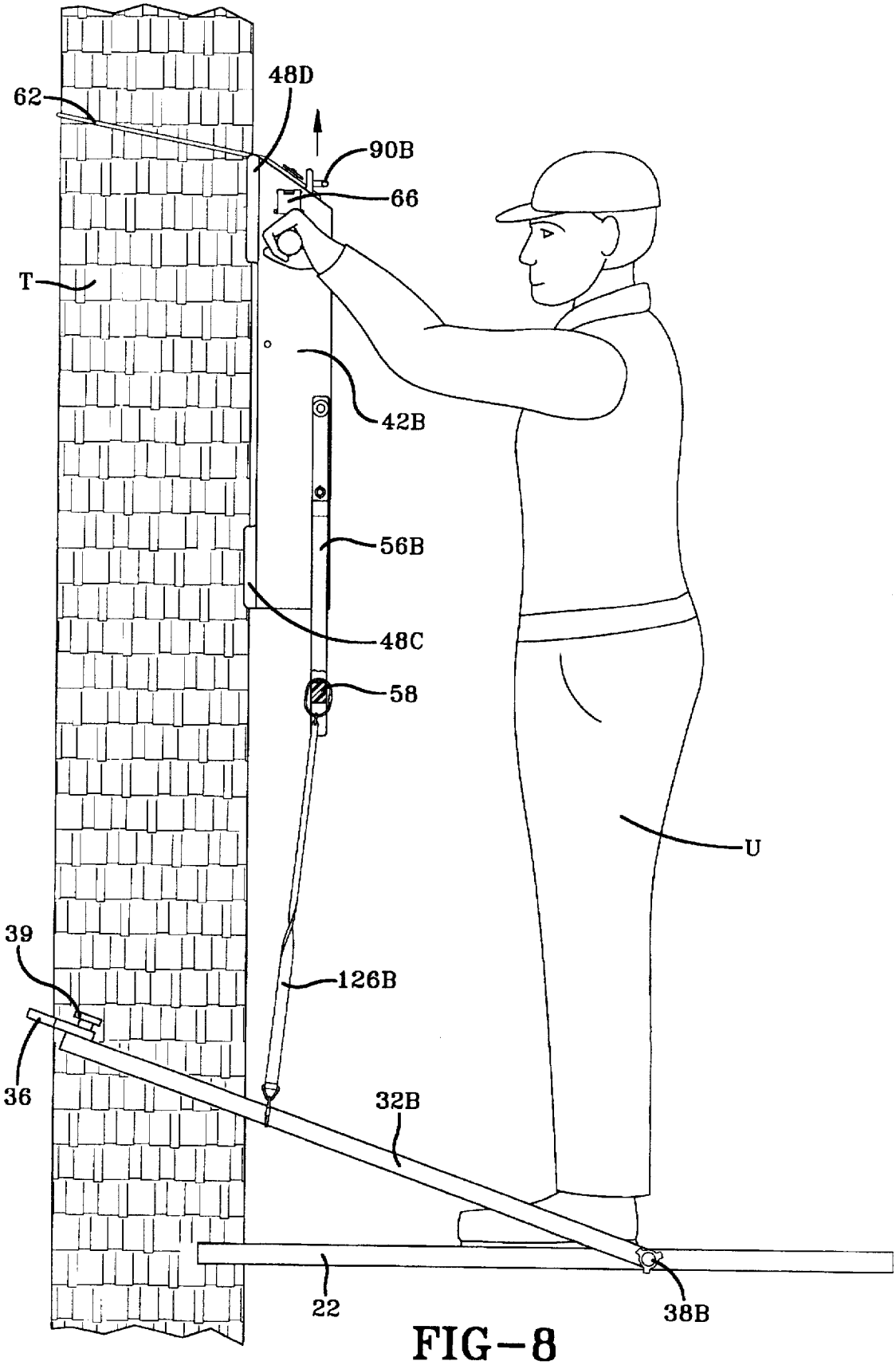
FIG. 8 is a side elevational view of the tree climbing device of FIGS. 1–6 in a climbing position where the user has slid the upper climbing assembly up the column and away from the lower climbing assembly.

When climbing device A is attached to tree T as shown in FIG. 8, user U can utilize climbing device A to climb tree T by the below described iterative release and slide process. When climbing device A reaches a preselected height, it can be converted to a support for user U. The process is an iterative two step process. Step 1 includes releasing pawl 86 and urging upper climbing assembly C upward. Step 2 includes the relocking of pawl 86 and the shifting of the user's weight to allow lower climbing assembly B to follow upper climbing assembly C up tree T.

Specifically, user U stands on grate 24 and releases pawl 86 to allow slack in cable 62 such that cable 62 no longer retains upper climbing assembly C tightly against tree T. The user then uses handles 50A and 50B to urge upper climbing assembly C upward along tree T as is shown in FIG. 8. This upward urging stretches elastic connectors 126A and 126B resulting in a greater separation between upper and lower climbing assemblies C and B. After the user U has sufficiently stretched elastic connectors 126A and 126B, the user then allows all of the slack in cable 62 to rewind such that loop 98 locks in keyhole 92. The user also relocks pawl 86 into one of the teeth 88 thereby prohibiting the release of any additional cable 62 from tray 72. Throughout the process of releasing pawl 86, urging the upper assembly upward, rewinding the slack cable, and relocking the pawl, the lower climbing assembly remains tightly held against tree T with user U supported thereon. Specifically, lower climbing assembly B is prohibited from sliding upward with the upper climbing assembly because of the user's weight on grate 24 which acts in a cantilever action by pulling cross connect arm 36 tightly against the back side of tree T while pushing tree engaging groove 30 into tight engagement with the front side of tree T.

Alternatively, when user U stands on grate 24 and releases pawl 86 to allow slack in cable 62, the user may prelock pawl 86 into one of the teeth 88 after only a portion of the slack in cable 62 is rewound. In this manner, cable 62 remains relatively loose around tree T when moved from a lower position to a raised position. When cable 62 is so locked against both expansion and retraction relative to tray 72, the user may raise upper climbing assembly C upwardly along the tree, the slack cable 62 also moving upwardly along the tree therewith. Thereafter, the weight of upper climbing assembly C will hang to a position below the position where cable 62 engages tree T. The weight of upper climbing assembly C will then be sufficient to secure cable 62 around tree T, and prevent upper climbing assembly C from moving relative to tree T and to grate 24. In this manner, the user may quickly climb tree T as it is not necessary to continually release pawl 86, and reengage pawl 86 with teeth 88. Regardless of whether pawl 86 is moved into and out of engagement with teeth 88 at each iteration of the climbing process, the interconnection between pawl 86 and teeth 88 assures that cable 62 will be prevented from retracting relative to tray 72.

Figure 9:
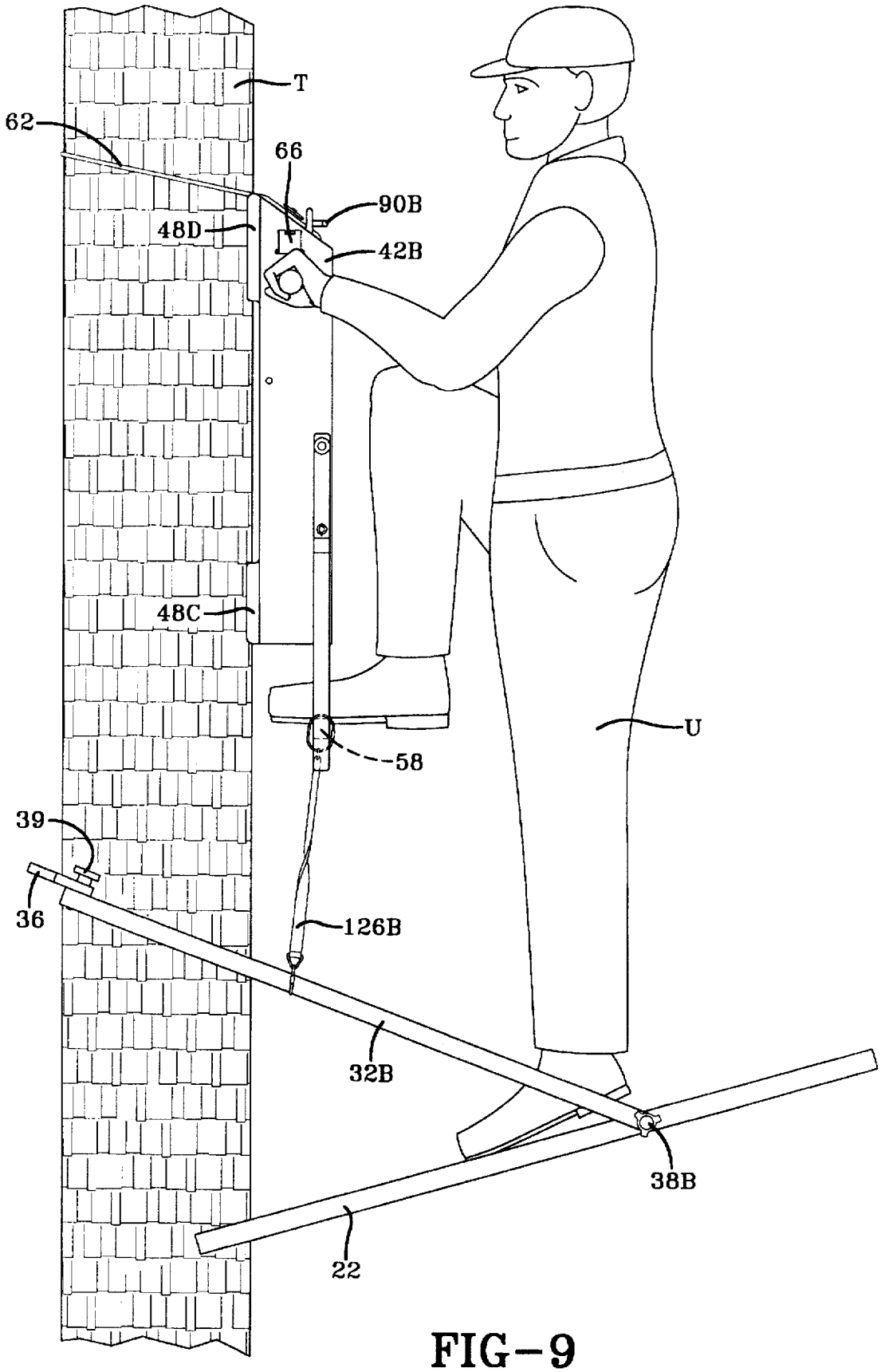
FIG. 9 is a side elevational view similar to FIG. 8 except that the user's weight is shifted to the upper climbing assembly to allow the lower climbing assembly to slide upward to complete one iteration of the climbing motion.

After raising upper climbing assembly C, user U shifts his weight off of grate 24 to allow lower climbing assembly B to move upward until the tension caused by the elongation of elastic connectors 126A and 126B is released. Specifically, the user steps off of grate 24 by shifting all of his weight to one foot positioned on cross connect arm 36 as is shown in FIG. 9. Lower climbing assembly B then rotates slightly upwardly and away from tree T thereby allowing the assembly to move upwardly. Particularly, lower climbing assembly rotates slightly upwardly and away from tree T such that the distance between cross connector arm 36 and groove 30 increases as a result of the rotation of frame 22 relative to support rods 32 at pivots 38. By increasing the distance between cross connecting arm 36 and engaging groove 30, lower climbing assembly B may be moved upwardly along the length of tree T. The user then shifts all of his weight back onto grate 24.

The above steps of releasing pawl 86, urging the upper assembly upward, and shifting the user's weight to cross connect arm 36 allows lower climbing assembly B to move upward approximately the same distance that upper climbing assembly C was previously moved. These steps are repeated as many times is as necessary to move climbing device A up the tree to the desired position.

Figure 11:
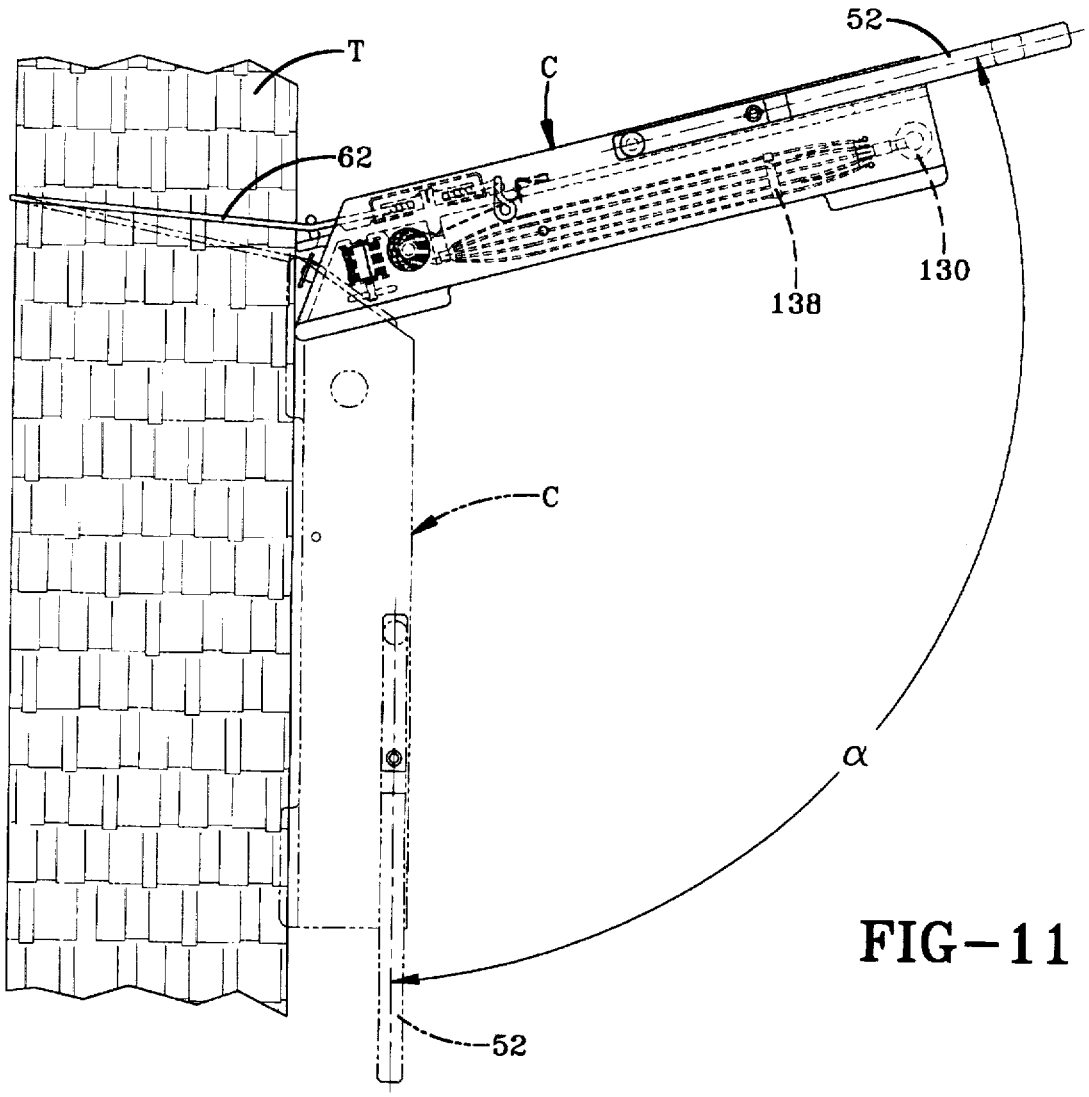
FIG. 11 is a side elevational view of the upper climbing assembly rotated from the climbing position shown in dot-dash lines to the tree stand position shown in solid lines.

After these iterations are complete and climbing device A is properly positioned, elastic connectors 126A and 126B are removed from cross-connect arm 36 thereby separating upper and lower climbing assemblies. Upper climbing assembly C is pivoted about its connection via cable 62 which remains taut based upon the interaction of pawl 86 and teeth 88 and the interaction of loop 98 and slot 96. This pivoting moves upper climbing assembly from a position substantially parallel to tree T (FIG. 1) to an angled position relative to tree T (FIG. 11). Upper climbing assembly C is rotated through an angle alpha relative to tree T, which is shown particularly in FIG. 11. Angle alpha may have a variety of sizes, but is preferably greater than 90 degrees and is sufficient to position edge 150 and stop 152 solidly against tree T.

Figure 12:
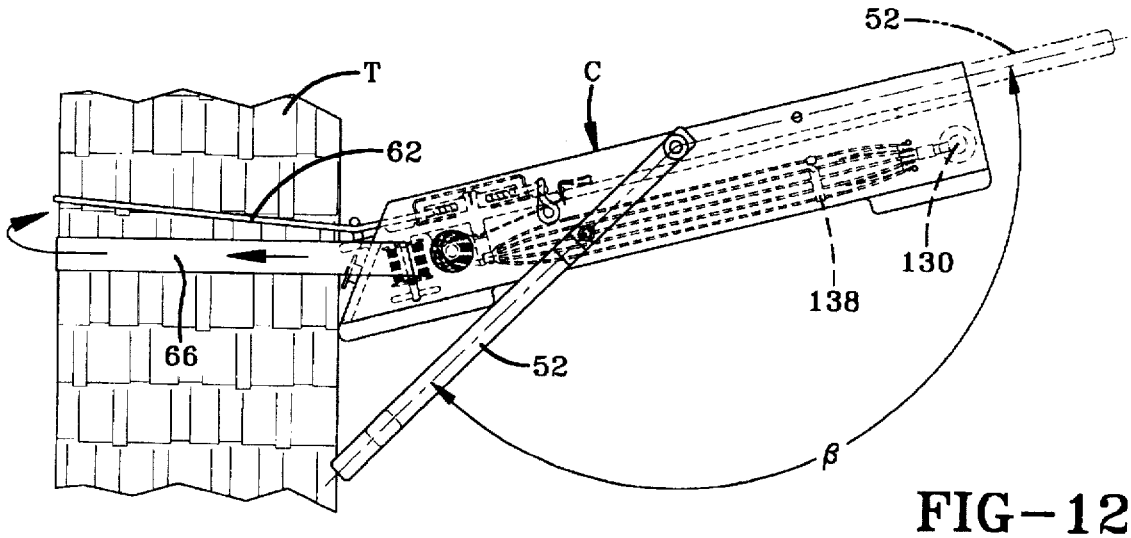
FIG. 12 is a side elevational view similar to FIG. 11 with the step rotated from the position shown in dot-dash lines to the position shown in solid lines.
Figure 13:
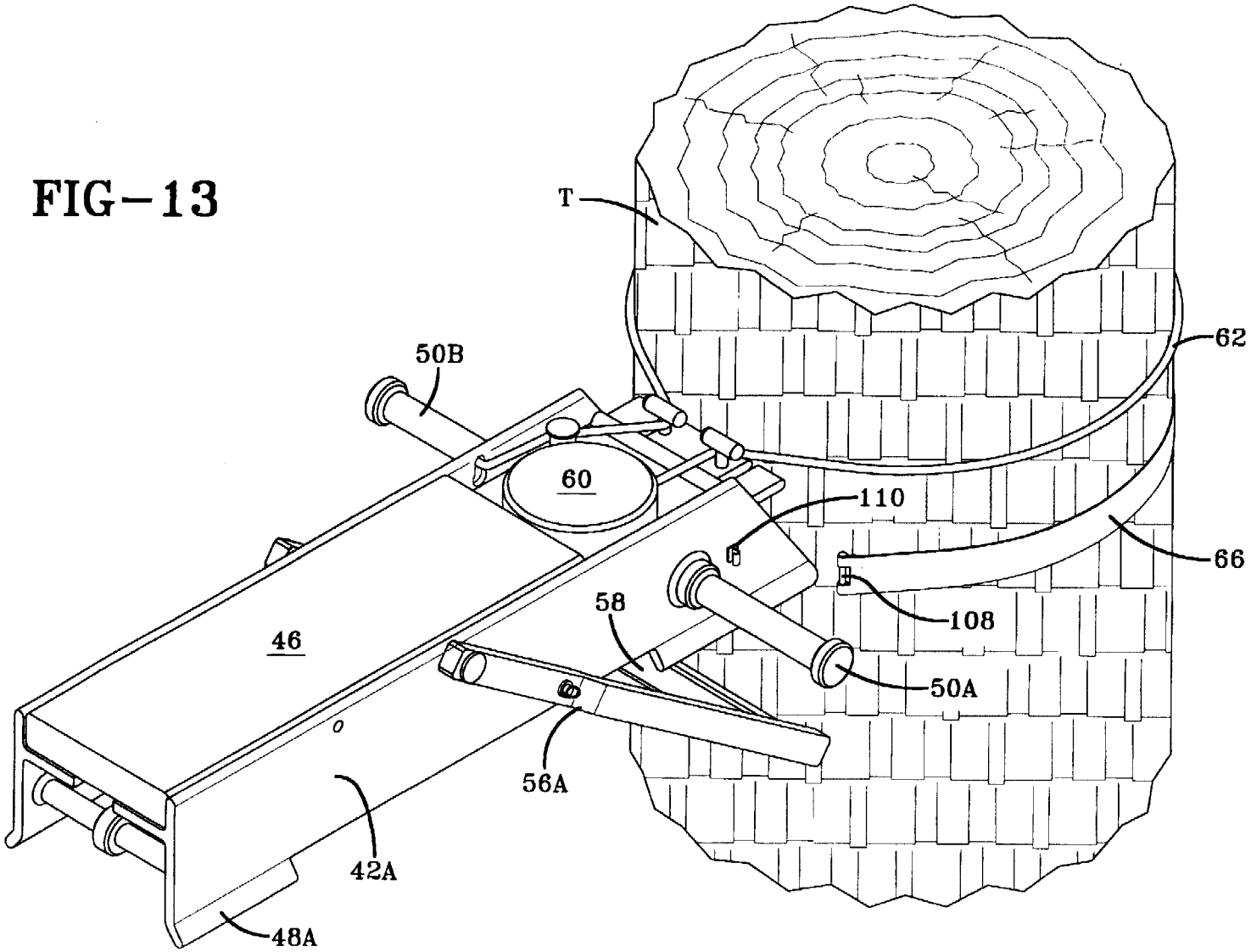
FIG. 13 is a perspective of the upper climbing assembly showing the safety belt about to be locked.

Snap locks 57A and 57B are released so as to allow step 52 to pivot about lugs 56A and 56B. Step 52 is pivoted downward until cross-connect arm 36 touches tree T as is shown in FIG. 12. Cross-connect arm 36 acts as a support when weight is suspended from the free end of upper climbing assembly C. Safety belt 66 is then unwound from spool 102 and wrapped around tree T. Fastener 108 is connected to latch 110 as is shown in FIG. 13. Spool 102 is then locked to prohibit further unwinding of safety belt 66 from spool 102 so as to add a second securing device for tightly securing upper climbing assembly to tree T.

Umbrella 128 is supplied to protect user U from the elements. Umbrella 128 may be pivoted about pivot pin 130 along pivot angle THETA as is shown in FIG. 14. When umbrella 128 is in the desired upright position, the umbrella is locked in the open position to prohibit further pivoting.

Further protection from the environment may be provided by suspending camouflage panels 140 from rods 134 via strings 45. Camouflage panels provide some protection from the environment, but are more commonly used to provide camouflage protection. Inasmuch as the panels are suspended from strings 45 to a position below the user's line of sight when positioned in sling 122, the user is effectively camouflage from animals positioned on the ground, and is provided a clear view of the ground intermediate strings 45 and above panels 140.

Support belt 70 is then pulled out of slit 116, along frame 40, and under upper climbing assembly C as is shown in FIG. 15. Fastener 118 is attached to hooking mechanism 120 on sling 122. The user may now sit in climbing device A as is shown in FIG. 16. After upper climbing assembly C is rotated to the position shown in FIG. 11, and cross connect arm 36 touches tree T as shown in FIG. 12, the locking device then secures support belt 70 against further unwinding. Referring to FIG. 16, the user is then positioned within sling 122 and is supported against falling via flexible seat 153 and safety strap 157. Strap 157 and seat 153 combine to form a safety sling which prevents the user from inadvertently falling out of climbing device A.

When the user wishes to climb down from the tree. The above described process is merely reversed and the user may iteratively climb down the tree.

Figure 17:
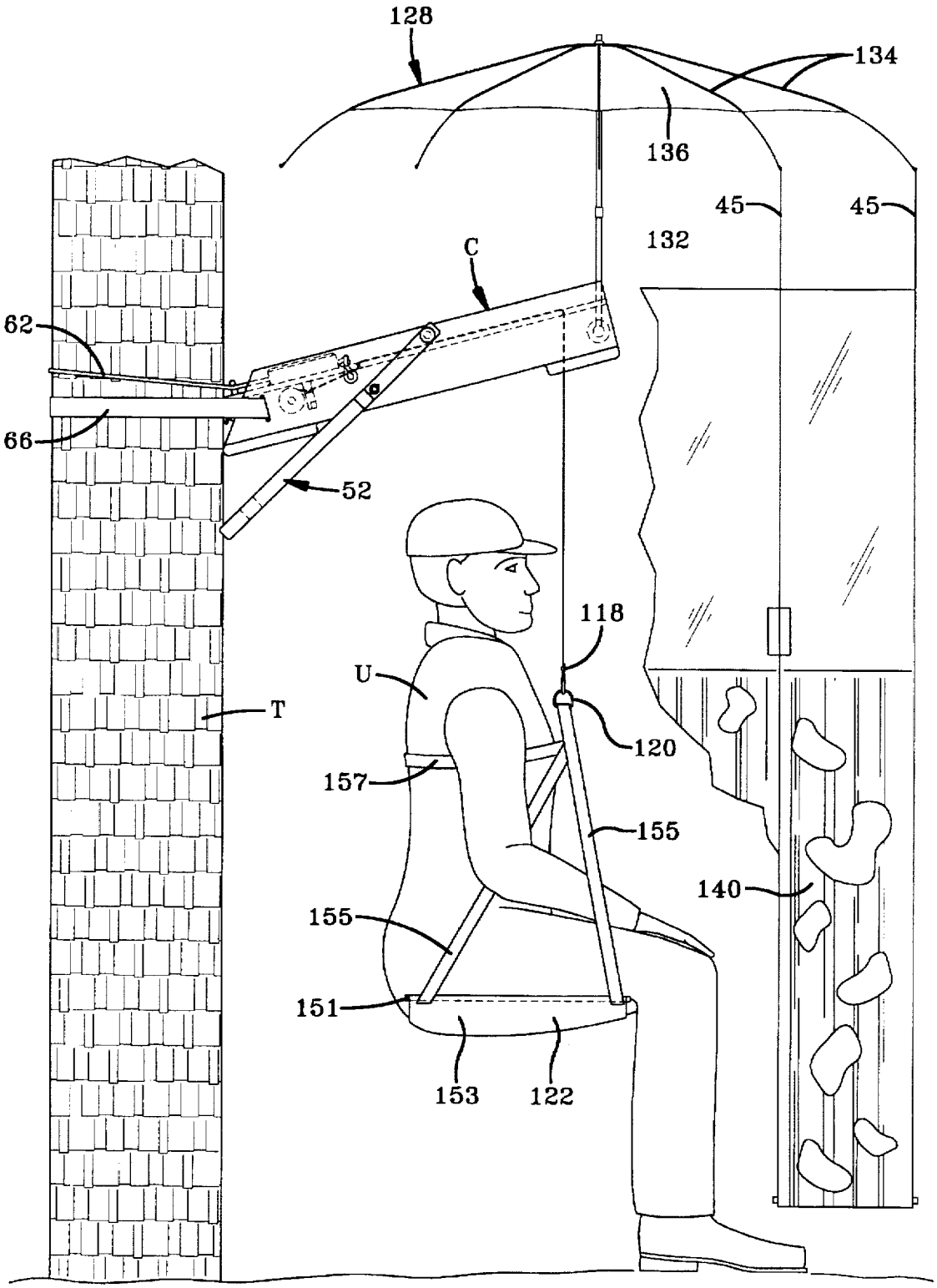
FIG. 17 is an elevational view similar to FIG. 16, but positioned adjacent the ground and without the lower climbing assembly.

Alternatively, and referring specifically to FIG. 17, the user may wish to utilize only upper climbing assembly C by engaging the trunk of a tree T, adjacent the ground, for sports such as turkey hunting, and for viewing and photographing birds and wild life adjacent the ground. In this manner, all of the benefits of the present invention which are provided after the same has been utilized to climb the tree, are beneficial in this position. Specifically, the user remains camouflaged, and suspended within the sling for silent movement to 360 degrees. Additionally, when the user is positioned such as shown in FIG. 17, the user remains more comfortably positioned while remaining camouflaged, and therefore will be able to withstand longer time periods engaged in the chosen activity, i.e., hunting, wild life and nature photography, etc.

Accordingly, the improved upright column climbing device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved upright column climbing device is constructed and used, the characteristics of the construction, and the advantageous, new and useful results obtained; the new and useful structures, devices, elements, arrangements, parts and combinations, are set forth in the appended claims.

I claim:

1. An apparatus for climbing a generally vertical columnar member and for supporting a user during both the climbing process and in a final elevated position after climbing is complete, the apparatus comprising:

an upper climbing assembly adapted to engage the generally vertical columnar member;

at least one elongated cable adapted to extend around the columnar member a cable retraction mechanism for accepting the elongated cable whereby the cable retraction mechanism automatically retracts the cable around the columnar member;

a lower climbing assembly adapted to engage the generally vertical columnar member;

at least one elastic member connecting the upper assembly to the lower climbing assembly whereby the at least one elastic member assists in raising the lower climbing assembly toward the upper climbing assembly;

a user support for suspending the user from the upper climbing assembly, above the lower climbing assembly.

2. The apparatus as defined in claim 1 in which the upper climbing assembly has two opposing handles adapted for urging the upper climbing assembly away from the lower climbing assembly.

3. The apparatus as defined in claim 1 in which the upper climbing assembly has at least one pair of opposing bent edges adapted for receiving the generally vertical columnar member.

4. The apparatus as defined in claim 1 in which the upper climbing assembly has a support belt at least partially wound around a support belt retraction mechanism and adapted to support the user support whereby the support belt retraction mechanism is carried within the upper climbing assembly.

5. The apparatus as defined in claim 4 in which the user support is a sling attached to the support belt and adapted to suspend the user above the lower climbing assembly.

6. The apparatus as defined in claim 5 in which a sling includes an upper safety belt adapted to extend below the user's shoulders.

7. The apparatus as defined in claim 1 further comprising an umbrella rotatably attached to the upper climbing assembly whereby the umbrella is retained with the upper climbing assembly when in a collapsed position.

8. A method of climbing a generally vertical columnar member so as to reach an elevated position and securely remain there for a period of time; the method comprising:

affixing, to a generally vertical columnar member to be climbed, a two piece climbing apparatus comprising an upper assembly elastically connected to a lower assembly;

stretching the elastic connection so as to move the upper assembly further apart from the lower assembly;

releasing the lower assembly from the generally vertical columnar member;

moving the lower assembly closer to the upper assembly;

repeating the stretching, releasing and moving steps to move the two piece climbing apparatus up the generally vertical columnar member to a desired elevation; and the affixing step further includes the step of: wrapping a cable around the generally vertical columnar member to affix the upper assembly thereto; and releasing an automatic locking mechanism to permit the length of the cable extending around the vertical column member to be expanded; and activating the automatic locking mechanism to prevent the cable from expanding around the vertical column member after the upper assembly has been reaffixed to the general vertical column member and before a user's weight is shifted from the lower assembly to the upper assembly.

9. The method as defined in claim 8 in which the stretching step includes the further steps of:

releasing the upper assembly from the generally vertical columnar assembly;

sliding the upper assembly away from the lower assembly;

re-affixing the upper assembly to the generally vertical columnar assembly; and shifting the user's weight from the lower assembly to the upper assembly before releasing the lower assembly from the generally vertical columnar member.

10. The method as is set forth in claim 9 in which the affixing step includes the further steps of:

holding the lower assembly against the generally vertical columnar member; and wedging a columnar member receiving groove on the lower assembly against the generally vertical columnar member so that any weight on the lower assembly acts to bind the lower assembly against the generally vertical columnar member.

11. An apparatus for climbing a generally vertical columnar member and for supporting a user during both the climbing process and in a final elevated position after climbing is complete, the apparatus comprising:

an upper climbing assembly adapted to engage the generally vertical columnar member;

a step mounted to the upper climbing assembly;

a lower climbing assembly adapted to engage the generally vertical columnar member;

at least one elastic member connecting the upper and lower climbing assemblies; and a user support for suspending the user from the upper climbing assembly, above the lower climbing assembly.

12. The apparatus as defined in claim 11 in which the step is pivotally mounted to the upper climbing assembly for moving between a position substantially parallel to the columnar support member to a position angled relative to the columnar support member whereby the step at least partially supports the upper climbing assembly when angled relative to the columnar support member.

13. The apparatus as defined in claim 11 in which the cable retraction mechanism includes a rotatable cable tray and a spring biasing means for biasing the cable tray to rotate in one direction; in which the elongated cable is at least partially wrapped around the cable tray whereby rotation of the cable tray results in unwinding of the elongated cable.

14. The apparatus as defined in claim 13 in which the cable retraction mechanism includes a one-way locking means for preventing the tray from rotating in one direction, and for permitting rotation in the other direction; and in which stop means are formed on the end of the cable for preventing the cable from withdrawing completely into the tray.

15. The apparatus as defined in claim 11 in which the upper climbing assembly has a safety belt at least partially wound around a safety belt retraction mechanism and adapted to secure the upper climbing assembly to the generally vertical columnar member.

16. An apparatus for climbing a generally vertical columnar member and for supporting a user during both the climbing process and in a final elevated position after climbing is complete, the apparatus comprising:

an upper climbing assembly adapted to engage the generally vertical columnar member;

a lower climbing assembly adapted to engage the generally vertical columnar member;

at least one elastic member connecting the upper and lower climbing assemblies;

a user support for suspending the user from the upper climbing assembly, above the lower climbing assembly;

an umbrella rotatably attached to the upper climbing assembly whereby the umbrella is retained with the upper climbing assembly when in a collapsed position; and a plurality of shades suspended from the umbrella.

17. The apparatus as defined in claim 16 in which the shades are camouflaged; and in which at least one of the shades is suspended from a plurality of strings at an elevation below the user's eyes.

18. A method of climbing a generally vertical columnar member so as to reach an elevated position and securely remain there for a period of time; the method comprising:

affixing, to a generally vertical columnar member to be climbed, a two piece climbing apparatus comprising an upper assembly elastically connected to a lower assembly;

stretching the elastic connection so as to move the upper assembly further apart from the lower assembly;

releasing the lower assembly from the generally vertical columnar member;

moving the lower assembly closer to the upper assembly;

repeating the stretching, releasing and moving steps to move the two piece climbing apparatus up the generally vertical columnar member to a desired elevation;

releasing the upper assembly from the generally vertical columnar assembly;

sliding the upper assembly away from the lower assembly;

re-affixing the upper assembly to the generally vertical columnar assembly;

shifting a user's weight from the lower assembly to the upper assembly before releasing the lower assembly from the generally vertical columnar member;

wrapping a cable around the generally vertical columnar member to affix the upper assembly thereto;

releasing a locking mechanism to permit the length of the cable extending around the vertical column member to be expanded; and activating the locking mechanism to prevent the cable from expanding around the vertical column member after the upper assembly has been reaffixed in the general vertical column member and before the user's weight is shifted from the lower assembly to the upper assembly;

holding the lower assembly against the generally vertical columnar member;

wedging a columnar member receiving groove on the lower assembly against the generally vertical columnar member so that any weight on the lower assembly acts to bind the lower assembly against the generally vertical columnar member; and pivoting a lower end of the upper assembly outward away from the generally vertical columnar member after repeating the stretching and releasing step as many times as necessary to move the two piece climbing apparatus up the generally vertical columnar member to a desired elevation.

19. The method as defined in claim 18 including the further steps of:

pivoting a step attached to the upper assembly for a position generally parallel to the columnar assembly to a position extending intermediate the upper columnar assembly and the vertical columnar after the lower end of the upper assembly has been pivoted outwardly away from the generally vertical columnar member.

20. The method as defined in claim 18 including the further step of:

wrapping a strap around the columnar member after the lower end of the upper assembly has been pivoted outwardly away from the general vertical columnar member.

21. The method as defined in claim 18 including the further step of:

hanging a seat for the user from the lower end of the upper assembly after having been pivoted outward away from the generally vertical columnar member.

22. The method as defined in claim 18 including the further step of:

positioning an umbrella above the climbing apparatus after repeating the stretching and releasing step as many times as necessary to move the two piece climbing apparatus up the generally vertical columnar member to a desired elevation.

23. The method as is set forth in claim 22 further comprising:

suspending camouflaging shields from the umbrella after positioning an umbrella above the climbing apparatus.

24. An apparatus for climbing a generally vertical columnar member and for supporting a user during both the climbing process and in a final elevated position after climbing is complete, the apparatus comprising:

an upper climbing assembly adapted to engage the generally vertical columnar member;

a lower climbing assembly adapted to engage the generally vertical columnar member;

at least one elastic member connecting the upper assembly to the lower climbing assembly whereby the at least one elastic one elastic member assists in raising the lower climbing assembly toward the upper climbing assembly;

a user support for suspending the user from the upper climbing assembly, above the lower climbing assembly; and an umbrella rotatably attached to the upper climbing assembly whereby the umbrella is retained with the upper climbing assembly when in a collapsed position.

* * * * *